US005931456A

United States Patent [19]

Laidlaw

[11] Patent Number: 5,931,456

[45] Date of Patent: Aug. 3, 1999

[54] FINE-PITCH PAPER ADJUSTMENT GUIDE FOR IMAGE FORMING DEVICES

[75] Inventor: Anthony G. Laidlaw, Boise, Id.

[73] Assignee: Hewlett-Packard Company, Palo Alto, Calif.

[21] Appl. No.: 08/926,191

[22] Filed: Sep. 9, 1997

[51] Int. Cl.[6] ..... B65H 1/00; B65H 31/20

[52] U.S. Cl. ..... 271/171; 271/223; 271/234

[58] Field of Search ..... 271/171, 223, 271/234; 74/78, 77, 76, 75

[56] References Cited

U.S. PATENT DOCUMENTS

| | | | |
|---|---|---|---|
| 3,819,028 | 6/1974 | Drillick | 197/82 |
| 5,332,209 | 7/1994 | Romansky et al. | 271/171 |
| 5,511,770 | 4/1996 | Okazaki | 271/171 |
| 5,611,528 | 3/1997 | Nakamura et al. | 271/171 |
| 5,643,319 | 7/1997 | Green et al. | 606/218 |
| 5,713,570 | 2/1998 | Ouchi | 271/171 |

FOREIGN PATENT DOCUMENTS

| | | | |
|---|---|---|---|
| 0084730 | 6/1980 | Japan | 271/171 |
| 0209227 | 8/1989 | Japan | 271/171 |
| 403133837 | 6/1991 | Japan | 271/171 |
| 404144840 | 5/1992 | Japan | 271/171 |
| 2089771 | 4/1982 | United Kingdom | 271/171 |

*Primary Examiner*—William E. Terrell
*Assistant Examiner*—Wonki Park

[57] ABSTRACT

The invention includes an adjustable media tray for an image forming device such as a printer, copier or facsimile machine. The media tray incorporates a media guide which is slidably mounted on the tray. The media tray and associated guide incorporate a releasable locking mechanism which, when engaged, permits the guide to be slidably moved in one direction, but prevents the guide from being slidably moved in the opposite direction. The locking mechanism incorporates a plurality of pawls and at least one ratchet rack with equally-spaced, ramp-shaped teeth. Each of the teeth has a vertical edge. Each of the pawls has associated therewith a plurality of teeth of a single rack, and each of the pawls is adapted to sequentially engage a vertical edge of each of its associated plurality of teeth. Engagement of each pawl with the vertical edge of each of its associated plurality of teeth is out of phase with engagement of each other pawl with the vertical edge of each of its associated plurality of teeth. The out-of-phase arrangement is provided either with multiple, offset pawls which operate on the evenly-spaced teeth of a single linear ratchet rack, or with multiple offset racks, each of which has associated therewith a pawl. In either case, the amount of offset between the pawls of the former arrangement or the racks of the latter arrangement is equal to the period, or distance, between teeth, divided by the number of racks or pawls.

20 Claims, 9 Drawing Sheets

FINE-PITCH PAPER ADJUSTMENT GUIDE FOR IMAGE FORMING DEVICES

BACKGROUND OF THE INVENTION

1. Field of the Invention

This invention relates to media adjustment guides for media supply trays commonly incorporated in image forming devices such as copy machines and printers. More particularly, it relates to adjustment guides which can be injection molded from polymeric organic compounds, such as plastic materials.

2. Description of Related Art

When loading printing media, such as sheets of paper or transparencies, into a media supply tray of an image forming device such as a copy machine, printer or facsimile machine, it is generally easier to adjust the position of the media guide(s) once the media is in place. This is particularly true when the media is of nonstandard size. Presently, the media guides of most media trays require adjustment prior to loading the media. Damage to the media is a likely result if the order is reversed. In addition, many guides permit adjustment to only standard media sizes. The use of nonstandard size media may cause misfeeds or misaligned placement of the image on the media. Some guides, although designed to provide infinite adjustment, are relatively complicated and costly, in addition to being difficult to operate. If such a guide requires adjustment prior to loading of the media, the user must know the size of the media in order to avoid a hit-and-miss approach. Other guides, though designed to provide infinite adjustment after the media has been loaded, are maintained in the set position by friction. Such a guide may shift during operation, causing misfeeding of the media, media jams in the copying/printing device, or misalignment of the printed image.

The design of prior-art guide-adjustment mechanisms will now be briefly discussed. Certain guides employ a rack and pawl design. When the rack ad pawls are fabricated from plastic materials, tooth pitch on the rack must be sufficiently coarse to prevent rapid wear or shearing of the rack teeth. A coarse rack pitch prevents fine adjustment of the guide. Often, tooth pitch of such designs is set for standard media sizes, resulting in poor guide positioning for nonstandard media sizes. Other media guides are removably inserted in locating holes. Such guides may be repositioned to various other locations equipped with locating holes. However, the locating holes provide positioning of the guide for only standard media sizes, and the guide must generally be set in the proper position prior to loading the media. Some guides are designed to permit infinite adjustment, but adjustment is relatively awkward. One such design requires the user to squeeze two parts of the guide together to release the guide, and then slide the guide in a direction that is perpendicular to the squeezing motion.

What is needed is a media tray incorporating a media guide having a durable mechanism which provides for fine-pitch adjustments, and which may be fabricated from relatively soft polymeric plastic compounds.

SUMMARY OF THE INVENTION

The invention fills the heretofore expressed need for a media tray incorporating a media guide having a durable mechanism which provides for fine-pitch adjustments, and which may be fabricated from plastic materials.

For a first embodiment of the invention, the tray incorporates a single linear ratchet rack having a plurality of equally-spaced teeth set in a common plane. A media adjustment guide is slidably mounted on the tray, being movable in a direction that is both perpendicular to one edge of a rectangular media, and perpendicular to the linear apex of each tooth. The adjustment guide incorporates a spring-biased pivotally-mounted guide lock having n (n being an integer>1) number of pawls, each of which may engage a single tooth of the ratchet rack as the adjustment guide is slidably moved within the media tray. The multiple pawls are evenly spaced over the distance between each adjacent pair of ratchet teeth. Thus, as the adjustment guide is moved from an extended position (i.e., one which accommodates large media) to a more closed position (i.e., one which accommodates a smaller media), the multiple pawls sequentially engage each tooth of the ratchet rack. The adjustment guide may be repositioned to the extended position by releasing the guide lock by rotating it about its pivotal axis and then sliding the guide in the desired direction. Rotation of the guide lock disengages all pawls from the teeth of the ratchet rack. The guide lock is spring biased so that all of its pawls are normally in constant contact with the ratchet rack. Given such an arrangement, the adjustment guide may be moved only unidirectionally (i.e., from an extended position to a more closed position) while the guide lock in the unreleased position. When the guide lock is rotated to the released position, bidirectional movement of the media guide is possible.

A second embodiment of the invention is functionally equivalent to the first embodiment. However, rather than incorporating multiple pawls that are evenly spaced over the distance between each adjacent pair of ratchet teeth, the guide lock incorporates identically-aligned multiple pawls, while the media tray incorporates multiple ratchet racks, each of which engages a single pawl. The teeth of each ratchet rack are evenly offset from the teeth of another rack, with the offset (O) being calculated by the formula: $O=d/n$, where d is distance between adjacent teeth on each rack, and n is the number of pawls or racks. The adjustment guide and guide lock of the second embodiment are operated by the user in a manner identical to that of the first embodiment.

For either of the foregoing principal embodiments, the pawls may be flexibly affixed to the guide lock (e.g., the guide lock and the pawls are injection molded as a single piece), or each may be pivotally mounted to the media guide, with spring biasing being provided between each pawl and the guide. In the former case, each of the pawls has sufficient flexibility to permit engagement of one of the pawls while each of the remaining pawls is elevated above the engaging pawl by a condition of only partial engagement of a tooth. In any case, each of the pawls must be able to move either independently or semi-independently of the others. Such an arrangement will later be amply described with reference to the drawings.

PREFERRED EMBODIMENT OF THE INVENTION

In its most basic form, the invention includes an adjustable media supply tray for an image forming device such as a printer, copier or facsimile machine. The media tray incorporates a media guide which is slidably mounted on the tray. The media tray and associated guide incorporate a releasable locking mechanism which, when engaged, permits the guide to be slidably moved in one direction, but prevents the guide from being slidably moved in the opposite direction. The locking mechanism incorporates a plurality of pawls and at least one ratchet rack with equally-spaced, ramp-shaped teeth. Each of the teeth has a vertical edge. Each of the pawls has associated therewith a plurality of teeth of a single rack, and each of the pawls is adapted to sequentially engage a vertical edge of each of its associated plurality of teeth. Engagement of each pawl with the vertical edge of each of its associated plurality of teeth is out of phase with engagement of each other pawl with the vertical edge of each of its associated plurality of teeth. The out-of-phase arrangement is provided either with multiple, offset pawls which operate on the evenly-spaced teeth of a single linear ratchet rack, or with multiple offset racks, each of which has associated therewith a pawl. In either case, the amount of offset between the pawls of the former arrangement or the racks of the latter arrangement is equal to the period, or distance, between teeth divided by the number of racks or pawls. Several embodiment of the invention will now be described with reference to drawing FIGS. 1 through 8.

Figure 1:
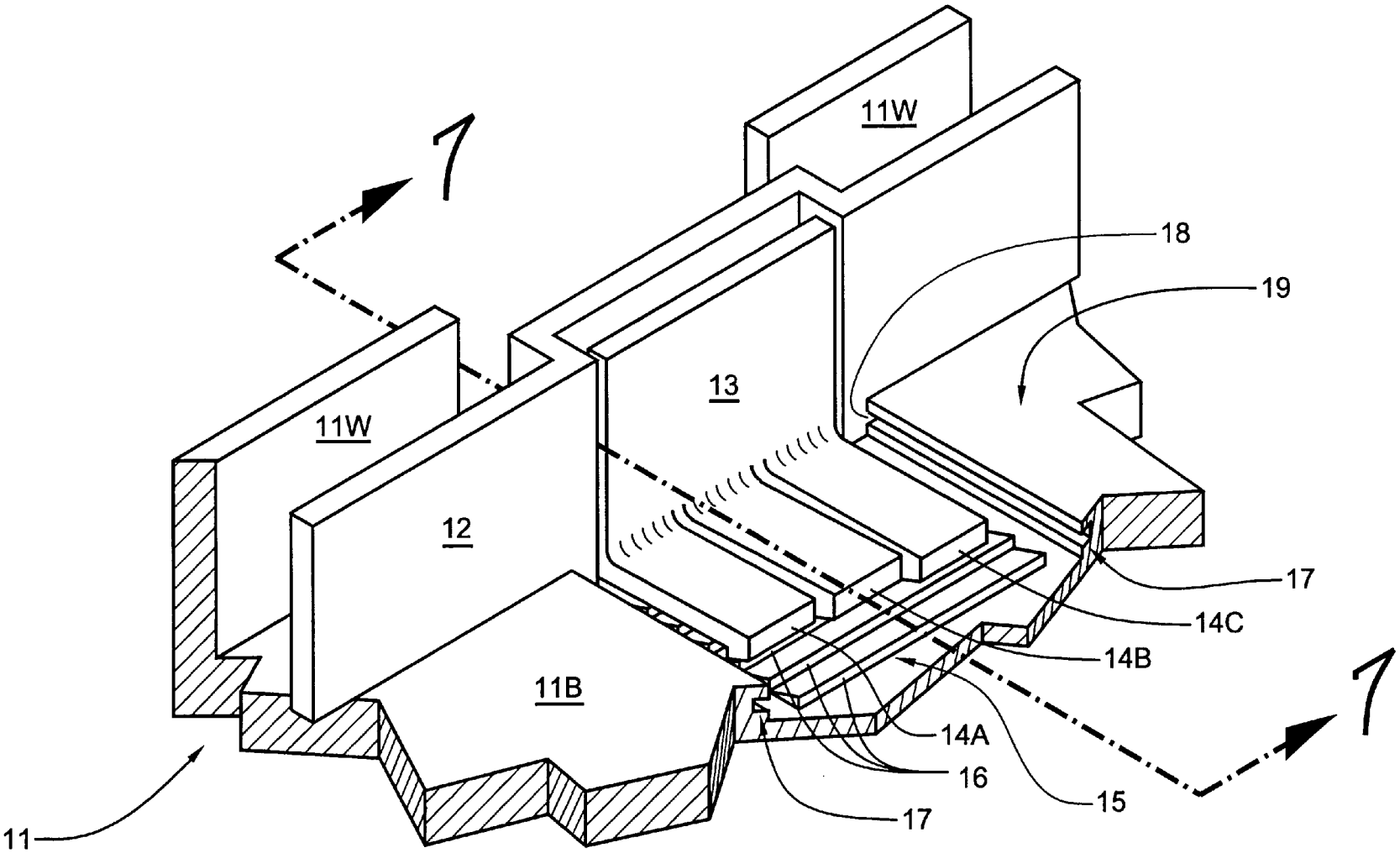
FIG. 1 is a partial cross-sectional isometric view of a media tray incorporating a first embodiment of the new adjustable fine-pitch media guide.
Figure 7:
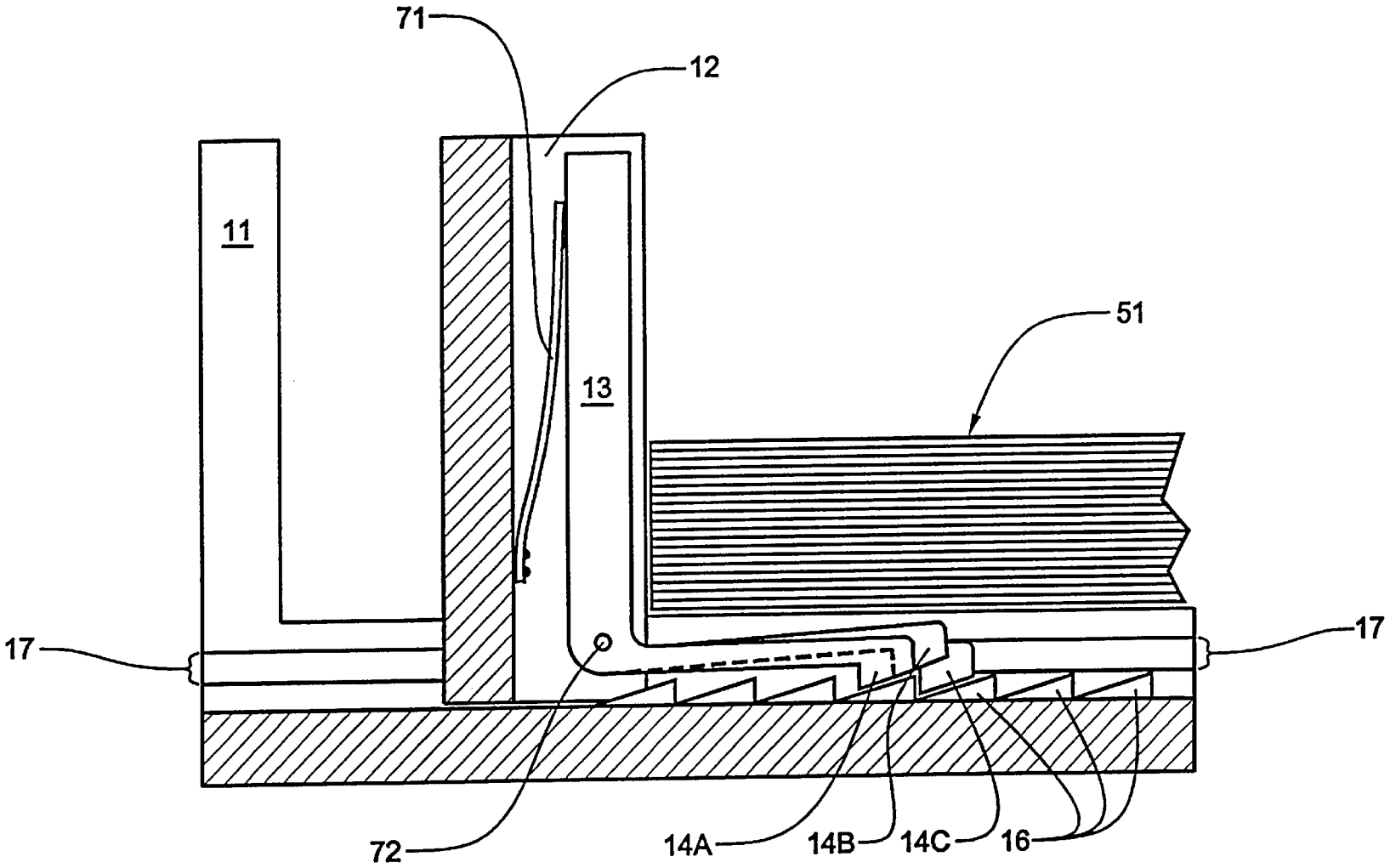
FIG. 7 is a cross-sectional view of the first embodiment media tray (with media loaded) through a plane passing through line 7—7 of FIG. 1.
Figure 8:
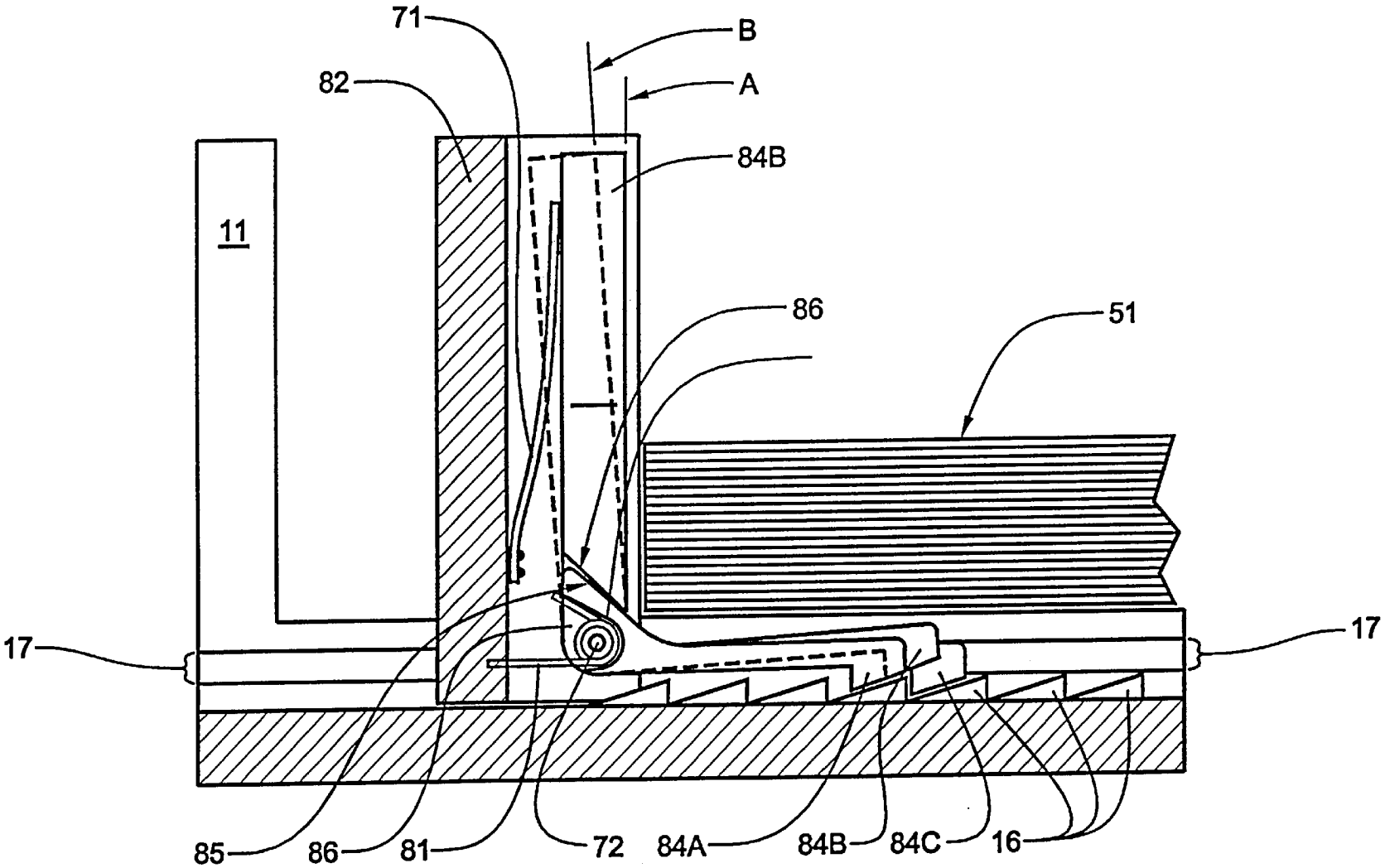
FIG. 8 is a cross-sectional view similar to that of FIG. 7 of an alternate embodiment media tray (with media loaded) which utilizes individual, pivotally-mounted, spring-biased pawls.

Referring now to a first embodiment of the invention depicted in FIG. 1, a media tray 11 has a base 11B with a media support surface 19, and a wall 11W which at least partially surrounds the media support surface. The base 11B incorporates a ratchet rack 15 having multiple, evenly-spaced teeth 16 and a pair of slotted tracks 17. A media guide 12 having a pair of retainer rails 18 (only one is visible in the view of FIG. 1) is slidably mounted within the media tray 11, with each retainer rail 18 sliding within a corresponding slotted track 17. Alternatively, the rails 18 may be located on the media tray 11, while the slotted tracks may be located on the media guide 12. A guide lock 13, which incorporates multiple pawls (in this case, three: 14A, 14B, and 14C), is pivotally mounted on the media guide. FIG. 7, which is a cross-sectional view taken through a plane passing through line 7—7, depicts the pivotal mounting scheme. The guide lock 13 is spring biased so that each of the three pawls is pressed against the teeth 16 of the ratchet rack 15. For the depicted embodiment, each of the pawls may flex somewhat over its length, thereby enabling a properly-aligned pawl to engage a tooth 16. Without such flexibility, which is induced by the spring biasing of the guide lock, engagement would be less than secure. FIG. 7 also depicts the spring biasing of guide lock 13. As the three pawls 14A, 14B, and 14C are evenly offset among themselves, only one of the three pawls may fully engage a tooth at any one time. The pawl offset is calculated by the formula: O=d/n, where d is distance, or period, between adjacent teeth on the rack, and n is the number of pawls. Thus, for the depicted embodiment, the offset O between any two pawls equals d/3. Clearly, the more pawls, the finer the adjustment possible. With the present invention, fineness of adjustment may be increased without decreasing the ruggedness of the rack teeth and pawls. With a single pawl system, it would be necessary to increase the number of teeth per unit distance. Finer teeth—especially if made of plastic—would be much more susceptible to stripping and rapid wear.

Still referring to FIG. 1, each of the teeth 16 of the ratchet rack 15 is a ramp which ends in a vertical face. Thus, all pawls may slide over the rack in one direction even when they are in spring-biased contact with the rack. However, the vertical wall of each tooth precludes movement in the opposite direction. In order to slide the guide in the opposite direction, the pawls 14A, 14B, and 14C must be disengaged from the teeth 16 of the ratchet rack 15.

Figure 2:
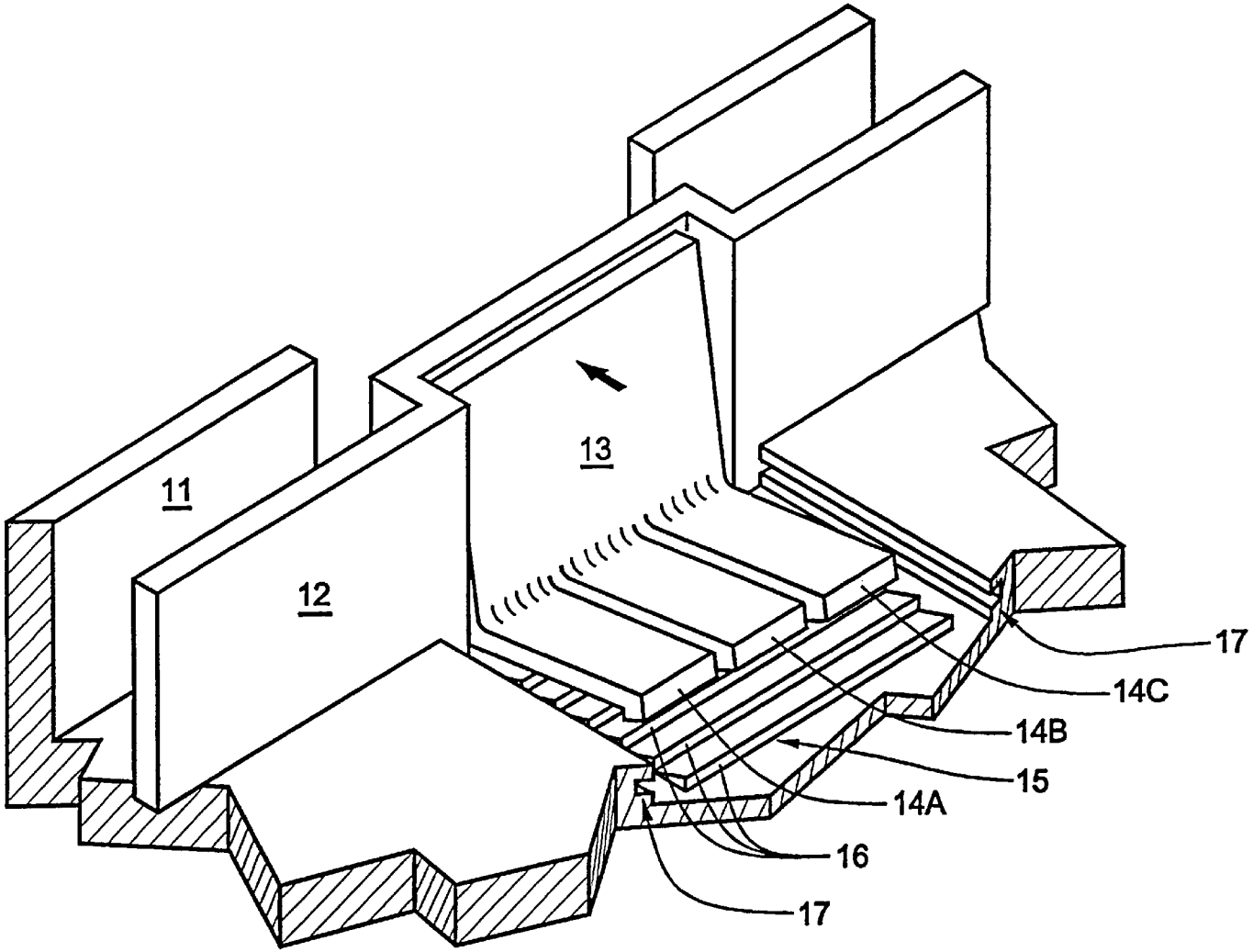
FIG. 2 is a partial cross-sectional isometric view of the media tray of FIG. 1 depicting rotation of the media guide lock so as to disengage the pawls thereof from the teeth of the ratchet rack which is integral with the media tray.
Figure 3:
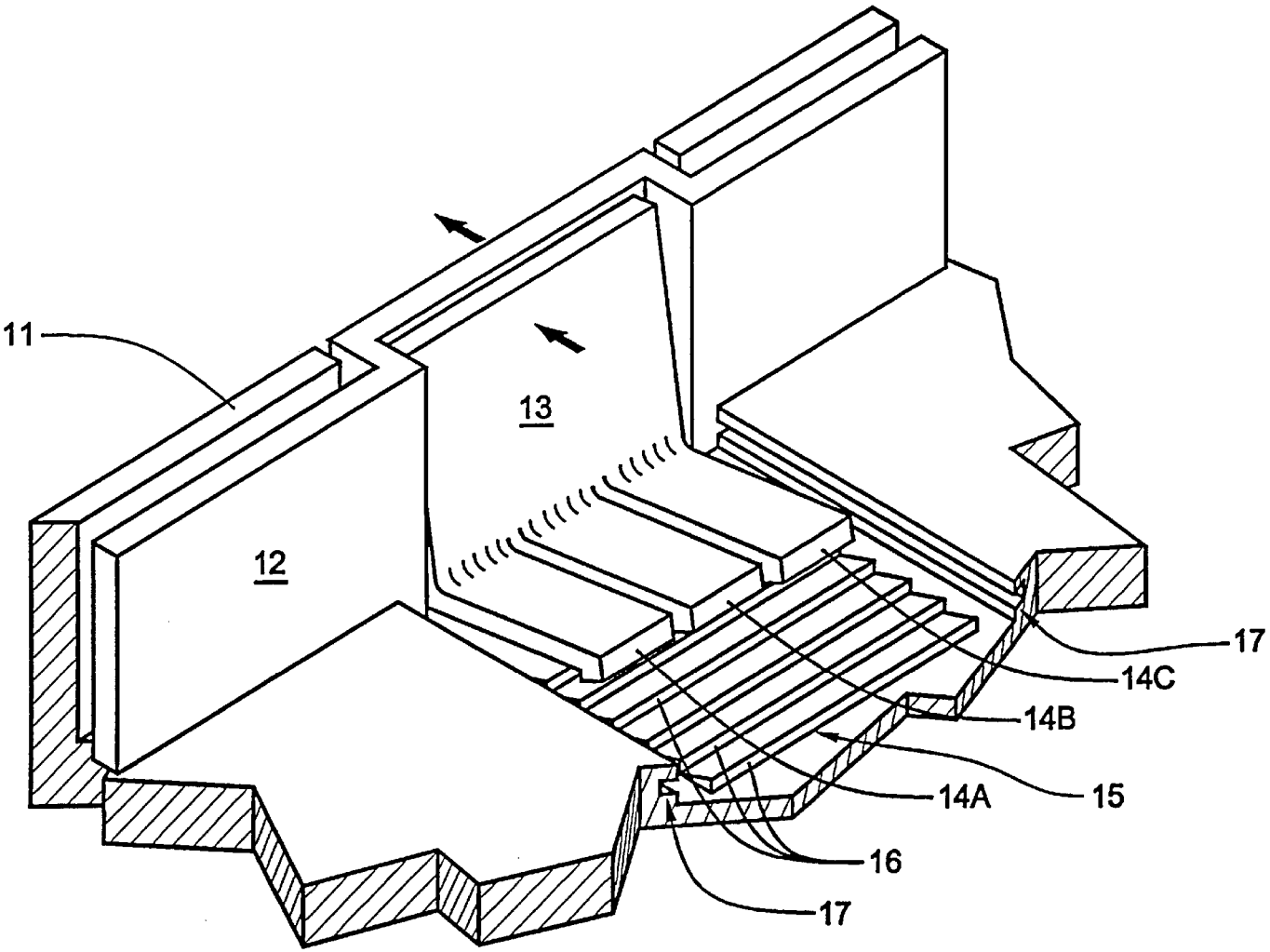
FIG. 3 is a partial cross-sectional isometric view of the media tray of FIG. 1 depicting movement of the media guide to an extended position while maintaining the media guide lock in a rotated position.
Figure 4:
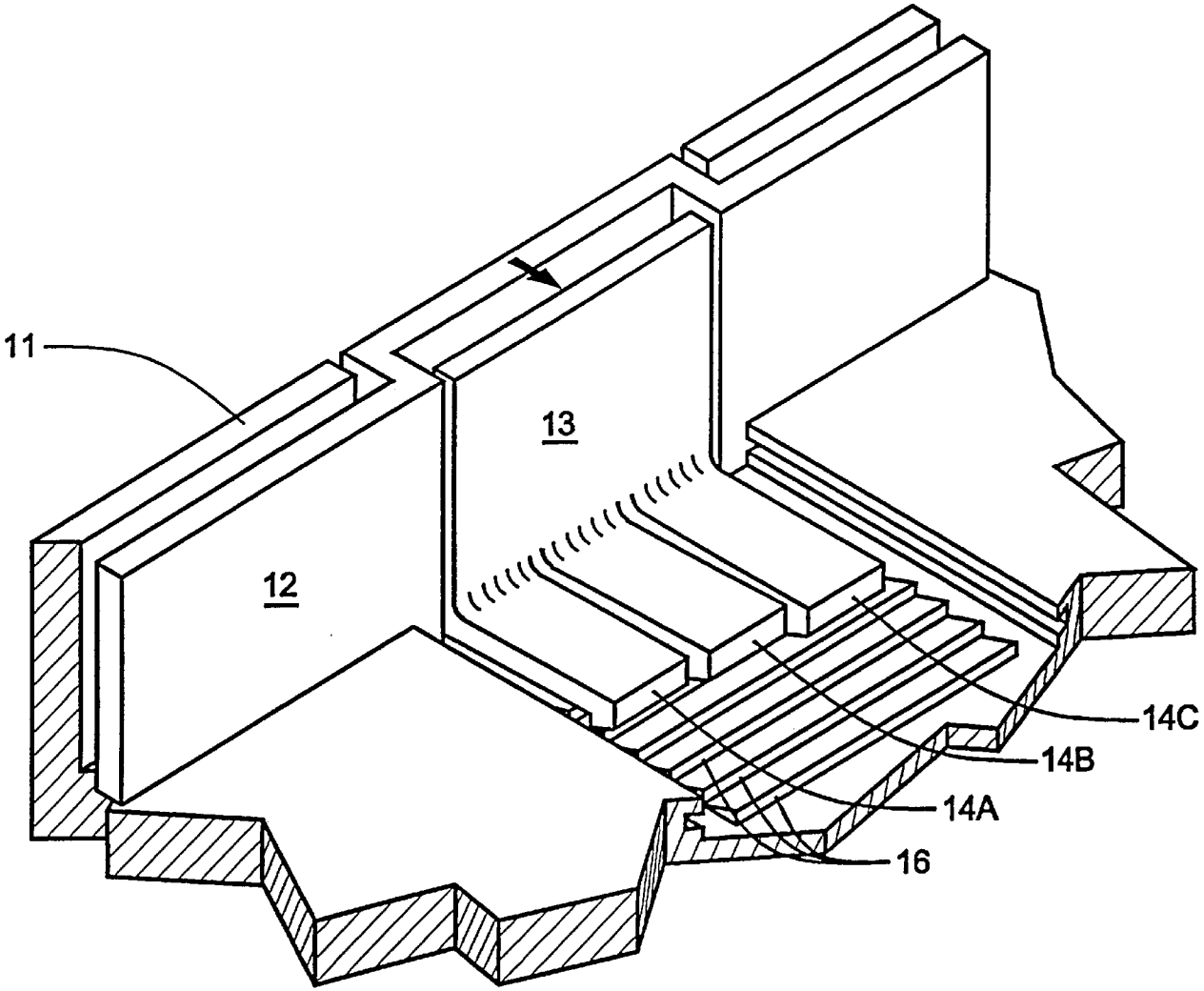
FIG. 4 is a partial cross-sectional isometric view of the media tray of FIG. 1 depicting release of the guide lock and concomitant engaging of the pawls thereof with the ratchet rack teeth while the media guide is in the extended position.

Referring now to FIG. 2, by rotatably tilting the guide lock 13 against the media guide 12, the pawls 14A, 14B, and 14C have been disengaged from the teeth 16 of the rack 15. With the pawls so disengaged, the media guide 12 may be repositioned to a more extended position (i.e., with the guide closer to the edge of the tray 11). Such movement is depicted by FIG. 3. Once the media guide has been repositioned, the guide lock 13 is released, and the pawls 14A, 14B, and 14C are once again brought into spring-biased contact with the teeth 16 of the ratchet rack 15. FIG. 4 depicts the release of the guide lock 13.

Figure 5:
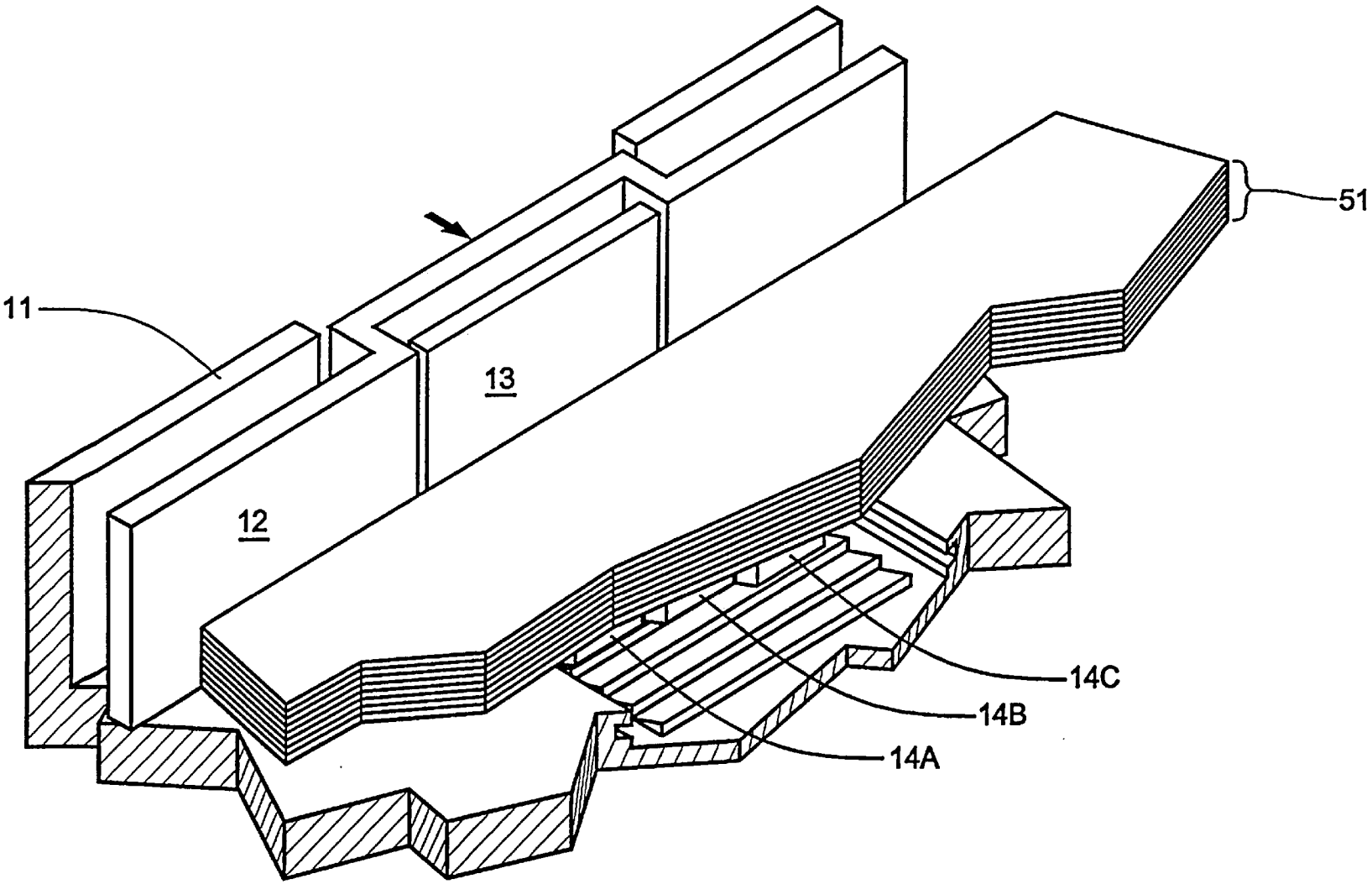
FIG. 5 is a partial cross-sectional isometric view of the media tray of FIG. 1 after loading a media stack, and sliding the media guide from the extended position to a more limited position against the media with the guide lock released.

Referring now to FIG. 5, a media stack 51, which may, for example, comprise sheets of paper or sheets of transparencies, has been loaded into the media tray 11. The media guide 12 is then moved against the media stack 51 until a snug fit is procured. Of the three pawls, only pawl 14C is depicted as being locked against the edge of a tooth 16. The locked engagement of pawl 14C with a single tooth of the ratchet rack effectively locks the media guide 12 in place.

Figure 6:
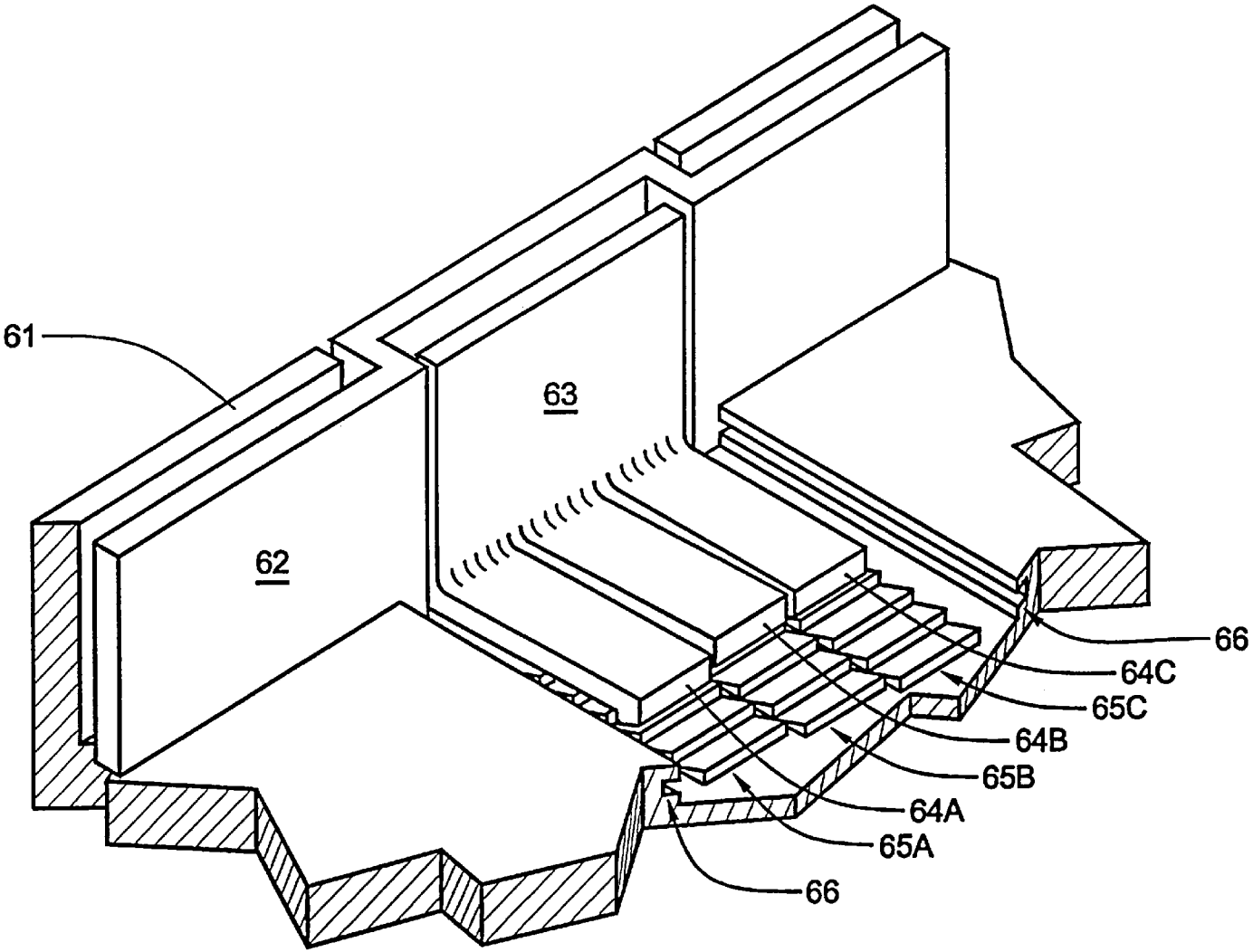
FIG. 6 is a partial cross-sectional isometric view of a media tray incorporating a second embodiment of the new adjustable fine-pitch media guide.

Referring now to FIG. 6, a second embodiment of the invention that is functionally equivalent to the first embodiment of FIGS. 1–5, has multiple (in this case, three) ratchet racks 65A, 65B and 65C. Rather than incorporating multiple pawls that are evenly spaced, or offset, over the distance between each adjacent pair of ratchet teeth, the guide lock incorporates identically-aligned multiple pawls, while each of the multiple racks engages a single pawl. The teeth of each ratchet rack 65A, 65B, and 65C are evenly offset from the teeth of another rack, with the offset (O) being calculated by the formula: O=d/n, where d is distance between adjacent teeth on each rack, and n is the number of pawls or racks. In this case the offset O is equal to d/3. The adjustment guide and guide lock of the second embodiment are operated by the user in a manner identical to that of the first embodiment. That is to say that each of the pawls 64A, 64B, and 64C is spring biased against the teeth of the rack over which it is positioned. As for the first embodiment depicted in FIG. 1, flexibility of each of the pawls over its length is essential for proper engagement of the pawl with the teeth of its respective rack.

Referring now the cross-sectional view of FIG. 7, which corresponds to the first embodiment of the invention also depicted in FIGS. 1 to 5, the slotted tracks 17 are much more clearly visibly in this view. Also visible is a flat spring 71 used to bias the pawls 14A, 14B and 14C against the teeth 16 of ratchet rack 15. The spring 71 is permanently anchored to the media guide 12. Also visible in this view is a pivot pin 72, on which the guide lock 13 is mounted. Each end of the pivot pin 72 is anchored in the media guide 12. A loaded media stack 51 is also depicted in this view. In this view, the engagement of each of the pawls with the teeth 16 of ratchet rack 15 is much more clear. Pawl 14C is fully engaged, with the pawl being fully seated against the vertical wall of a single tooth 16. The other two pawls, 14A and 14B, are not seated, but rather, are elevated higher than fully engaged pawl 14C by the ramped surface of the tooth 16 against which pawl 14C is fully seated.

Referring now to an alternate embodiment of the invention, which may be applied to both the single rack embodiment of the invention depicted in FIG. 1 through 5 and the multiple rack embodiment of the invention depicted in FIG. 6, each of the pawls 84A, 84B, and 84C is independent or separate from, though coupled to, the others. A coiled spring 81, one end of which is anchored in the media guide 82, the other end being biased against a surface of recess 86 molded into the pawl 84A, normally presses pawl 84A against the teeth 16 of the ratchet track. Although in this embodiment, pawl 84B is depicted as being biased by a flat spring 71, it could also be biased identically to pawl 84A. As the media guide 82 is slid from left to right, each of the pawls 84A, 84B, and 84C will bounce up and down independently as each traces a path over the teeth 16. Pawl 84C, a mirror image of pawl 84A, is also biased in the same manner as pawl 84A. Pawl 84B, on the other hand, also functions as a release handle which disengages all three pawls from the rack when it is tilted to contact the vertical surface of the media guide 82. This is accomplished because all three pawls are pivotally mounted on pivot pin 72, and when pawl 84B is tilted to contact the media guide 82, surface 86 of pawl 84B presses against surface 85 of pawl 84A and the corresponding surface on pawl 84C, causing both to disengage from the rack. Position A corresponds to the position of pawl 84B when fully seated against a tooth 16. In its depicted position, pawl 84B is not fully seated. Thus it actual position corresponds roughly to position B. Further rearward movement toward media guide 82 will cause the other two pawls to lift and disengage from the ratchet rack.

Figure 9:
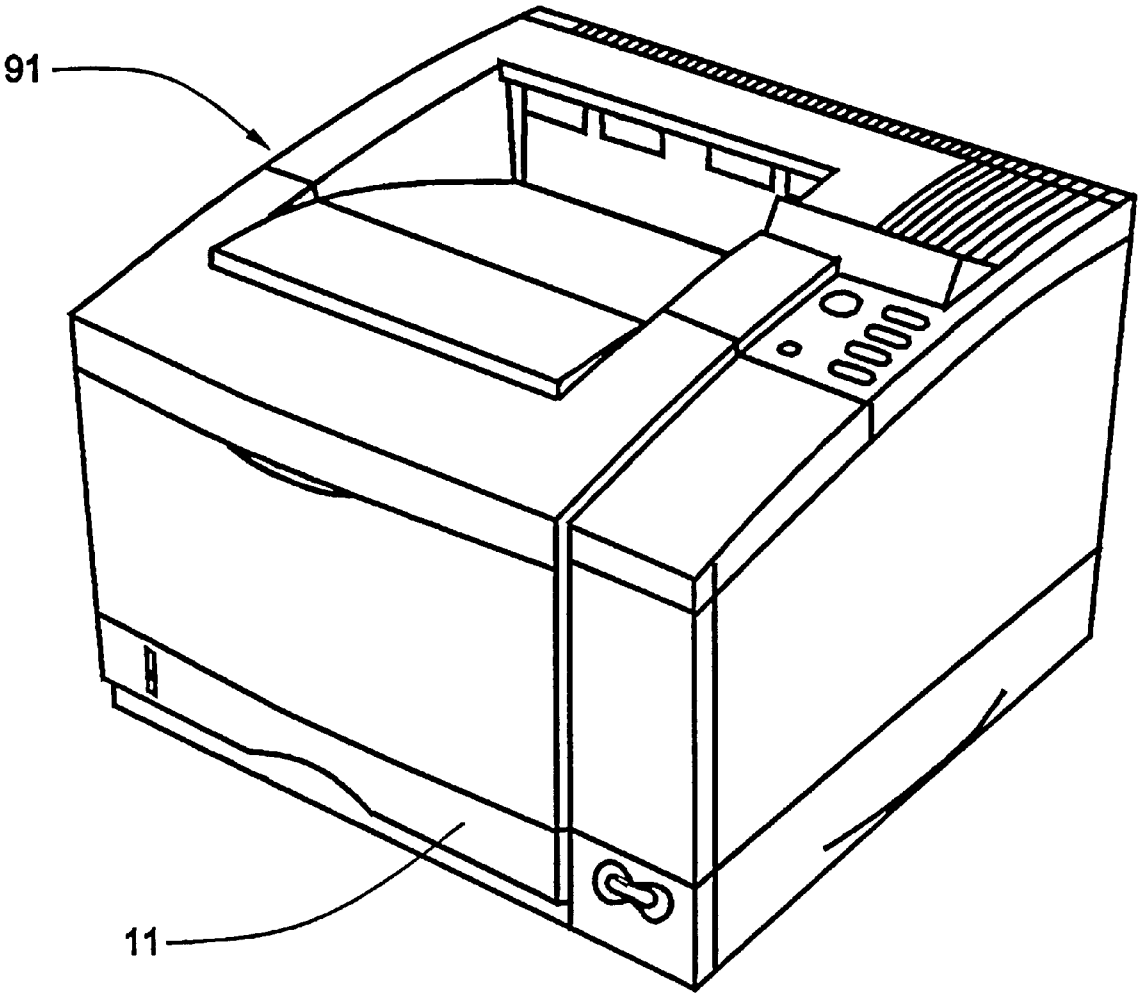
FIG. 9 is a laser printer having a media supply drawer which incorporates the invention.

FIG. 9 is a representative drawing of a laser printer 91 having a media supply drawer which may incorporate the invention. Other devices, such as ink jet printers, facsimile machines, copiers, may also incorporate the invention.

It should be evident that the heretofore described apparatuses are capable of providing a durable adjustment mechanism for the media guide of a media tray. The adjustment mechanism heretofore described incorporates a durable ratchet rack and multiple-pawl mechanism which provides for fine-pitch adjustments, and which may be fabricated from plastic materials.

Although only several embodiments of the adjustment mechanism are shown and described, it will be obvious to those having ordinary skill in the art that changes and modifications may be made thereto without departing from the scope and the spirit of the invention as hereinafter claimed. For example, the first principal embodiment which utilizes a single ratchet rack and multiple offset pawls could be implemented with separate racks for each offset pawl. Although with somewhat greater complexity, pawls could be attached to the tray, while the rack, or racks, could be attached to the media guide. The inventor considers both such variations to be equivalent to those herein described.

What is claimed is:

1. A media supply tray comprising:

a base having a media support surface and a wall which at least partially surrounds said media support surface;

a media guide slidably mounted on said base for adjustably defining a usable area of said media support surface, said media guide having a releasable locking mechanism which, when engaged, permits said guide to be slidably moved in one direction parallel to said support surface, but prevents said guide from being slidably moved in the opposite direction, said locking mechanism having a plurality of pawls and at least one ratchet rack with equally-spaced, ramp-shaped teeth, each tooth having a vertical edge, each of said pawls having associated therewith a plurality of teeth of a single rack, each of said pawls being adapted to sequentially engage a vertical edge of each of its associated plurality of teeth, engagement of each pawl with the vertical edge of each of its associated plurality of teeth being out of phase with engagement of each other pawl with the vertical edge of each of its associated plurality of teeth.

2. The media supply tray of claim 1, wherein said media guide and said tray are equipped with mating rails and tracks, which provide captive slidable motion of the media guide on said tray.

3. The media supply tray of claim 1, wherein a single ratchet rack is engaged by multiple pawls, each of which is offset from the others.

4. The media supply tray of claim 1, wherein each of multiple ratchet racks is engaged by single associated pawl, the teeth of each rack being offset from the teeth of the other racks, there being no offset between each of said pawls.

5. The media supply tray of claim 1, which further comprises a guide lock to which each of said pawls is rigidly affixed, said guide lock being pivotally mounted to and spring biased against said media guide, said guide lock disengaging each of said pawls from said ratchet racks when pivoted to override the spring bias.

6. The media supply tray of claim 1, wherein each of said pawls is independently and pivotally mounted to and spring biased against said media guide, each of said pawls disengaging the teeth of said ratchet racks when pivotally rotated away from said racks.

7. In combination with a printer, a media supply tray comprising:

a base having a media support surface and a wall which at least partially surrounds said media support surface;

a media guide slidably mounted on said base for adjustably defining a usable area of said media support surface, said media guide having a releasable locking mechanism which, when engaged, permits said guide to be slidably moved in one direction parallel to said support surface, but prevents said guide from being slidably moved in the opposite direction, said locking mechanism having a plurality of pawls and at least one ratchet rack with equally-spaced, ramp-shaped teeth, each tooth having a vertical edge, each of said pawls having associated therewith a plurality of teeth of a single rack, each of said pawls being adapted to sequentially engage a vertical edge of each of its associated plurality of teeth, engagement of each pawl with the vertical edge of each of its associated plurality of teeth being out of phase with engagement of each other pawl with the vertical edge of each of its associated plurality of teeth.

8. The media supply tray of claim 7, wherein a single ratchet rack is engaged by multiple pawls, each of which is offset from the others.

9. The media supply tray of claim 7, wherein each of multiple ratchet racks is engagable by single shared pawl, the teeth of each rack being offset from the teeth of the other racks.

10. In combination with a copier, a media supply tray comprising:

a base having a media support surface and a wall which at least partially surrounds said media support surface;

a media guide slidably mounted on said base for adjustably defining a usable area of said media support surface, said media guide having a releasable locking mechanism which, when engaged, permits said guide to be slidably moved in one direction parallel to said support surface, but prevents said guide from being slidably moved in the opposite direction, said locking mechanism having a plurality of pawls and at least on ratchet rack with equally-spaced, ramp-shaped teeth, each tooth having a vertical edge, each of said pawls having associated therewith a plurality of teeth of a single rack, each of said pawls being adapted to sequentially engage a vertical edge of each of its associated plurality of teeth, engagement of each pawl with the vertical edge of each of its associated plurality of teeth being out of phase with engagement of each other pawl with the vertical edge of each of its associated plurality of teeth.

11. The media supply tray of claim 10, wherein a single ratchet rack is engaged by multiple pawls, each of which is offset from the others.

12. The media supply tray of claim 10, wherein each of multiple ratchet racks is engagable by single shared pawl, the teeth of each rack being offset from the teeth of the other racks.

13. A media supply tray comprising:

a base having a media support surface and a wall which at least partially surrounds said media support surface;

a linear ratchet rack immovably affixed to said base parallel to said media support surface, said rack having a plurality of equally-spaced teeth;

a media guide slidably mounted on said base for adjustably defining a usable area of said media support surface, said media guide having a plurality of pawls adapted to engage the teeth of said rack, each of said pawls being offset from the others, the amount of offset being less than the distance between two adjacent teeth of said rack; and means for simultaneously disengaging each of said pawls from said teeth.

14. The media supply tray of claim 13, wherein said media guide and said tray are equipped with mating rails and tracks, which provide captive slidable motion of the media guide on said tray.

15. The media supply tray of claim 13, wherein said means for simultaneously disengaging comprises a guide lock pivotally mounted to said media guide, said guide lock having each of said pawls rigidly affixed thereto, said guide, as a consequence of spring biasing against the media guide, inducing each of the pawls, which are flexible over their lengths, to engage the teeth of said rack, said guide lock being pivotally movable to disengage the pawls from the teeth of said rack.

16. The media supply tray of claim 13, wherein said means for simultaneously disengaging comprises a plurality of pawls, each of which is independently and pivotally mounted to said media guide, each pawl, as a consequence of spring biasing against the media guide, being induced to engage the teeth of said rack, said spring biasing being overridable to disengage the pawls from the teeth of said rack.

17. A media supply tray comprising:

a base having a media support surface and a wall which at least partially surrounds said media support surface;

a plurality of ratchet racks immovably affixed to said base; each of said racks having a plurality of equally-spaced teeth, the teeth of each rack being offset from the teeth of the other racks, the amount of offset being less than the distance between two adjacent teeth of each rack;

a media guide for adjustably defining a usable area of said media support surface, said media guide being slidably mounted on said base in such a manner that it is movable in a direction parallel to said media support surface, said media guide having a plurality of pawls, each of said pawls adapted to engage the teeth of a single ratchet rack; and means for simultaneously disengaging each of said pawls from said teeth.

18. The media supply tray of claim 17, wherein said media guide and said tray are equipped with mating rails and tracks, which provide captive slidable motion of the media guide on said tray.

19. The media supply tray of claim 17, wherein said means for simultaneously disengaging comprises a guide lock pivotally mounted to said media guide, said guide lock having each of said pawls rigidly affixed thereto, said guide, as a consequence of spring biasing against the media guide, inducing each of the pawls, which are flexible over their lengths, to engage the teeth of its associated rack, said guide lock being pivotally movable to disengage the pawls from the teeth of said racks.

20. The media supply tray of claim 17, wherein said means for simultaneously disengaging comprises a plurality of pawls, each of which is independently and pivotally mounted to said media guide, each pawl, as a consequence of spring biasing against the media guide, being induced to engage the teeth of its associated rack, said spring biasing being overridable to disengage the pawls from the teeth of said racks.

* * * * *